United States Patent [19]

Elliott

[11] Patent Number: 5,035,031

[45] Date of Patent: Jul. 30, 1991

[54] METHOD AND APPARATUS FOR HEATED PRESSURIZED FLUID STREAM TREATMENT OF SUBSTRATE MATERIAL

[75] Inventor: John L. Elliott, Spartanburg, S.C.

[73] Assignee: Milliken Research Corporation, Spartanburg, S.C.

[21] Appl. No.: 513,148

[22] Filed: Apr. 23, 1990

[51] Int. Cl.[5] ..... D06C 23/00

[52] U.S. Cl. ..... 26/69 R; 26/2 R; 28/160; 28/163

[58] Field of Search ..... 26/2.2, 69 R; 28/160, 28/163

[56] References Cited

FOREIGN PATENT DOCUMENTS 3521858 1/1987 Fed. Rep. of Germany ..... 28/160

*Primary Examiner*—Werner H. Schroeder
*Assistant Examiner*—John J. Calvert
*Attorney, Agent, or Firm*—Kevin M. Kercher; H. William Petry

[57] ABSTRACT

A method and apparatus for treatment of relatively moving substrate materials by preheating the substrate before precise selective application of discrete, high temperature pressurized streams of fluid against the surface of the materials to impart a visual and tactile change thereto. The apparatus includes an elongate manifold for receiving heated pressurized fluid, such as air, disposed across the width of the relatively moving material and having a single slit the full width of the substrate for directing the fluid into the surface of the material. Pressurized cool fluid, such as air, is directed across selected portions of the manifold discharge slit to deflect pressurized heated air away from the substrate. The manifold is provided with cool air outlets which direct the heated air to a position upstream of the path of movement of the substrate for preheating purposes. The apparatus is further arranged and configured to enhance the visibility of faults in the substrate.

11 Claims, 4 Drawing Sheets

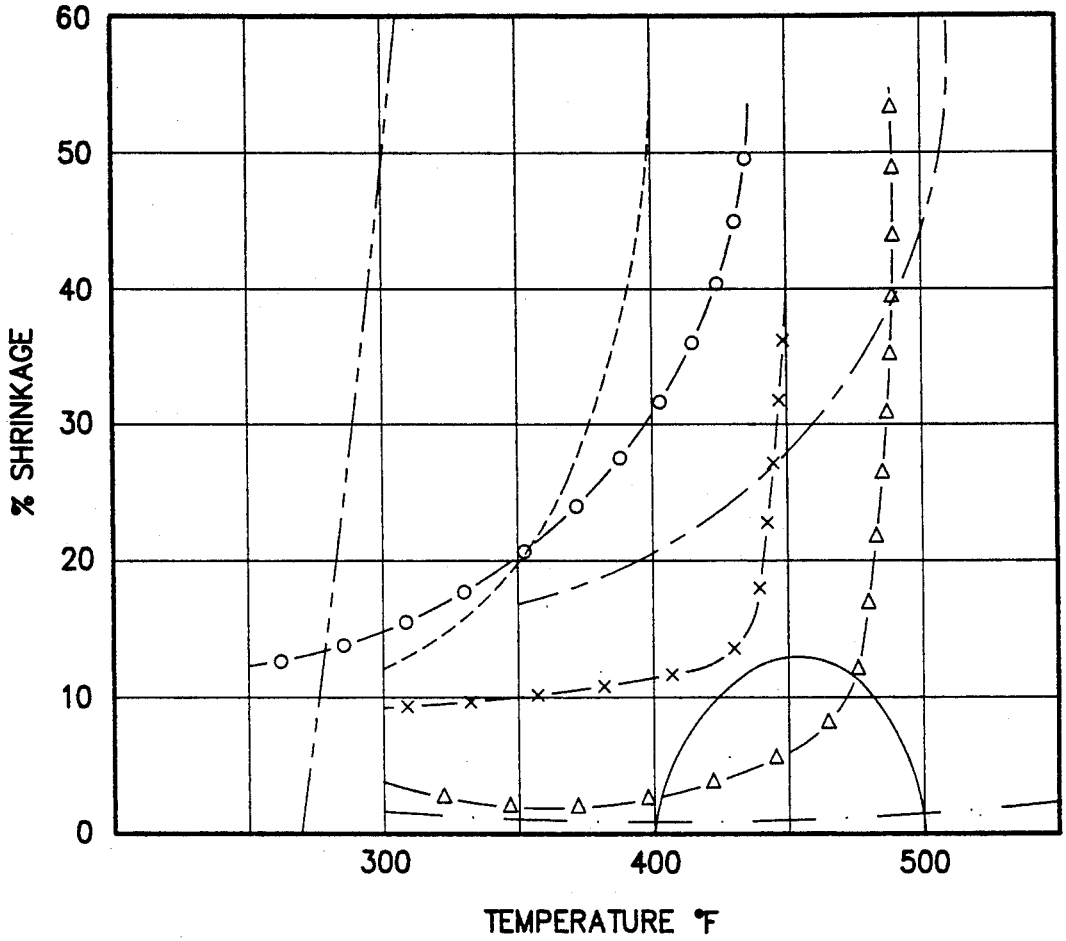
— - - — POLYPROPYLENE
—o— DACRON POLYESTER TYPE 56 100/54 R-02 (DUPONT)
- - - - - - - NYLON 6 ( E N K A )
— - — ORLON 1/24 BLEND 152 (DUPONT)
—×— NYLON 6/6 TYPE 74S 500/92/0 (DUPONT)
—Δ— ACRILAN (MONSANTO)
— · — RAYON
——— ACETATE 70 DENIER
*FIG. —5—*

METHOD AND APPARATUS FOR HEATED PRESSURIZED FLUID STREAM TREATMENT OF SUBSTRATE MATERIAL

This invention relates to improved method and apparatus for pressurized heated fluid stream treatment of relatively moving materials to provide visual and tactile surface effects thereon, and, more particularly, to improved method and apparatus for preheating, for the purpose of providing visual and tactile surface effects, thermally modifiable substrate such as a textile fabric containing thermoplastic yarn or other fiber components, including, but not limited, to rayon, nylon, polyester, polypropylene, acetate, wool, nomex, and polypyrrole treated quartz fabric. The apparatus is configured and arranged to facilitate location of faults while minimizing waste.

BACKGROUND OF THE INVENTION

Various apparatus have been proposed for directing heated pressurized fluid streams, such as air, onto the surface of moving textile fabrics to alter the location of or modify the thermal properties of fibers or yarns and provide a pattern or visual and tactile surface change in such fabrics. Examples of such prior art equipment and methods of application of the pressurized fluid streams to a relatively moving material are disclosed in the following U.S. Pat. Nos: 2,110,118; 2,241,222; 2,563,259; 3,010,179; 3,403,862; 3,434,188; 3,585,098; 3,613,186.

It is believed that such prior art treatment devices as described in the aforementioned patents, because of the nature of the equipment disclosed, are not capable of producing precise, intricate, or well defined patterns of wide variety on the fabrics, but generally can only produce limited, relatively grossly defined patterns, or surface modifications of a random, non-defined nature in the materials. In utilizing high temperature pressurized streams of fluid, such as air, to impart visual and tactile surface patterns to textile fabrics containing thermoplastic materials by thermal modification of the same, it can be appreciated that highly precise control of stream pressure, temperature, and direction is required in all of the individual heated streams striking the fabric, to obtain uniformity and preciseness in the pattern ultimately formed in the fabric. In addition, there are ever present difficulties in regulating the flow of high temperature fluid streams by use of conventional valving systems to selectively control the stream flow between on or off positions in accordance with pattern control information.

More recently, apparatus has been developed for more precisely and accurately controlling and directing high temperature streams of pressurized fluid, such as air, against the surface of a relatively moving substrate material, such as a textile fabric containing thermally modifiable fibers. Such apparatus includes an elongate pressurized heated air distributing manifold having a narrow elongate air discharge slit extending across the path of fabric movement in close proximity to the fabric surface. Located within the manifold is a shim plate to control the thickness of the slit through which the heated pressurized air passes in a narrow, precisely defined stream to impinge upon the adjacent surface of the fabric. Flow of the heated air stream from the slit is controlled by the use of pressurized cool air which is directed by individual cool air supply tubes communicating with the outlet of the elongate manifold to direct cool air across the outlet at a generally right angle to its discharge axis to deflect the passage of heated air away from the substrate. Each cool air tube is provided with an individual valve and the valves are selectively turned on and off in response to signal information from a pattern source, such as a computer program, to allow the heated air stream to strike the moving fabric in selected areas and impart a pattern thereto by thermal modification of the yarns. Examples of related apparatus, and associated methods, may be found in U.S. Pat. Nos. 4,364,156, 4,393,562, and 4,471,514.

In moving the fabric from a room temperature or otherwise ambient environment to the manifold or other delivery mechanism for producing the pattern, the types of patterns are limited by the effect of pressurized hot air impinging on a relatively cooler thermoplastic material.

This limitation manifests itself in two ways. In continuing to move the substrate downstream following treatment in an environment where turbulent, relatively hot air surrounds the substrate, there is the potential that the pattern can be somewhat disturbed or disrupted by the failure of the thermoplastic material to be quickly quenched. Additionally, where small patterns are desired, the heated air stream must heat and thermally modify the substrate in the brief period of time—as determined by the pattern commands—during which the uninterrupted heated air stream is allowed to strike the substrate. Some small patterns, for example, pin dot patterns, can require the heated air to strike the substrate for such a brief period of time that the heated air cannot transfer sufficient heat to the substrate to cause the desired thermal modification to take place within the intended localized area on the substrate. This inability can result in indistinct, irregular, or imperceptible patterns.

Furthermore, because a large portion of the manifold and other pattern carving apparatus extends downstream on the path of movement by the substrate, any faults that may occur are not readily visible until at least a substantial portion of the fabric has passed through the machine. This creates a substantial amount of waste, adding to the cost of the material and reducing the efficiency in operation of the machine.

The present invention provides an improved method and apparatus for uniformly patterning a relatively moving substrate material by selective application of heated pressurized fluid streams to the surface thereof with a preheating step to heat the substrate prior to the patterning step. Also, to this end there is utilized an improved elongate pressurized heated fluid distributing manifold means having a single sheet of hot fluid discharged which is selectively subjected to pressurized cool fluid for pattering substrate materials and direct a mixture of hot and cool fluid upstream of the path of substrate movement to preheat the thermoplastic components on the fiber.

The manifold means includes an elongate manifold housing which is disposed across the path of movement of the substrate material and has a single heated fluid discharge outlet for discharging a pressurized streams of heated fluid, such as hot air, into the surface of the substrate across its width to thermally modify and alter the surface appearance of the substrate. Discharge of the streams of heated air from the manifold housing outlet is controlled by selectively subjecting a pressurized fluid, such as air, having a temperature substantially lower than the temperature of the heated air, across the discharge outlet of the slit to deflect the heated air away from the substrate. The pressurized cool air is introduced at the hot fluid discharge slit at a substantially right angle to its discharge axis by an individual cool air supply line. A control valve for each supply line is operated in accordance with pattern information to activate and deactivate the flow of pressurized cool air to the heated air discharge slot.

The apparatus of the method includes locating the manifold, and particularly the outlet for discharging the sheet of heated air, adjacent a main driven substrate support roll in such a position that the pattern being generated by the heated air is put down across the width of the substrate and immediately moved over the roll in a direction away from the apparatus such that an operator can quickly detect any patterning faults in the substrate while the substrate containing the fault is still in close proximity to the air outlet. In this manner the patterned fabric is fully visible to the operator after only a relatively short length of fabric travel.

This allows any air outlet blockages or other patterning malfunctions to be both quickly observed and quickly associated with a given specific section or sections of the manifold, thereby providing an efficient defect detection and diagnostic system, and minimizing the production of off-quality substrate.

In addition to minimizing waste, certain advantages in the substrate itself are accomplished by the preheating apparatus noted above. With the apparatus of the invention the hot pressurized air to carve the subject is deflected and cooled by control air and directed upstream along the path of movement of the substrate. In this way the substrate is preheated, preferably to a temperature less than the melting point of the substrate, e.g., pile fabric. This is to be compared with other methods where the substrate is brought to the air distributing manifold at room temperature and immediately subjected to "hot" air to carve it. Then the substrate is moved immediately to a region of "warm" turbulent air in the aftermath of the next line of print. This disrupts the pile and carved areas in non-flat fabric substrate.

By preheating the substrate and moving the substrate in a direction such that it is subjected to ambient temperature directly after the print line, where it is allowed to quench, a number of advantages are achieved. The carving is undisturbed until the substrate has cooled. The result is a cleaner carving of the fabric.

Furthermore, the speed of the substrate transport through the pattern process can be increased, the softness of the hand of fabric substrates for a given degree of carve is improved, and substrates that could not be carved before can now be carved at acceptable production rates. It is believed that these benefits occur because of the preheating step that occurs as the substrate approaches the patterning area of the apparatus. This preheating is accomplished by a mixture of hot air that impinges on the substrate, and the cool deflecting air that is used to deflect the hot air from the substrate. This air heats the substrate as it approaches the air distributing manifold. The heating continues right up to the time that a line of pattern is put down on the substrate by contact of the substrate with the heated air streams. Thus, the substrate is heated slowly from room temperature to some temperature below the melt as the substrate approaches the manifold. In the case of a substrate comprised of a textile fabric, at the time of patterning, enough heat is supplied to the fiber to cause the temperature of the fiber to exceed the temperature at which localized melting of the fiber occurs. This causes the melted portion of the fiber to thicken and undergo longitudinal shrinkage. Once subjected to the heated pressurized air the individual fibers are thermally modified and exhibit a change in visual and/or tactile character.

As a consequence of this novel invention, the maximum speed of the substrate moving through the patterning process has generally increased, the softness of the hand of textile fabric substrates for a given degree of carve has much improved, and textile fabrics that could not be carved before can now be carved at acceptable production rates. The speed of transport for a given level of carve was able to be increased due to the fact that the carve at a given temperature was deeper. In general there was an increase in speed as well as a decrease in the temperature of the air necessary for an acceptable depth of carve. This contributes to the softer hand of the carved fabric.

The softness of hand is believed to be caused by the difference in shrinking of the yarn brought about by the new method. An individual fiber that had been processed before exhibited a clubbed end, or in extreme cases a ball of remelted polymer on the end of a fiber stalk or fiber. These remelted ends were harsh to the touch. An individual fiber that had been processed with preheating, on the other hand, shows characteristically as a fiber of uniform but increased diameter that had reduced in length. These fibers maintain, until extreme shrinkage is achieved, a soft hand similar to the original fabric.

The above has been a brief description of some problems with the prior art and advantages of Applicant's invention. Other features of the invention will be perceived by those skilled in the art from the detailed discussion of the preferred embodiment which follows.

BRIEF DESCRIPTION OF THE DRAWINGS

FIG. 5 is a graph comparing percentage of shrinkage as a function of temperature for a number of fiber types.

DETAILED DESCRIPTION OF THE PREFERRED EMBODIMENT

Figure 1:
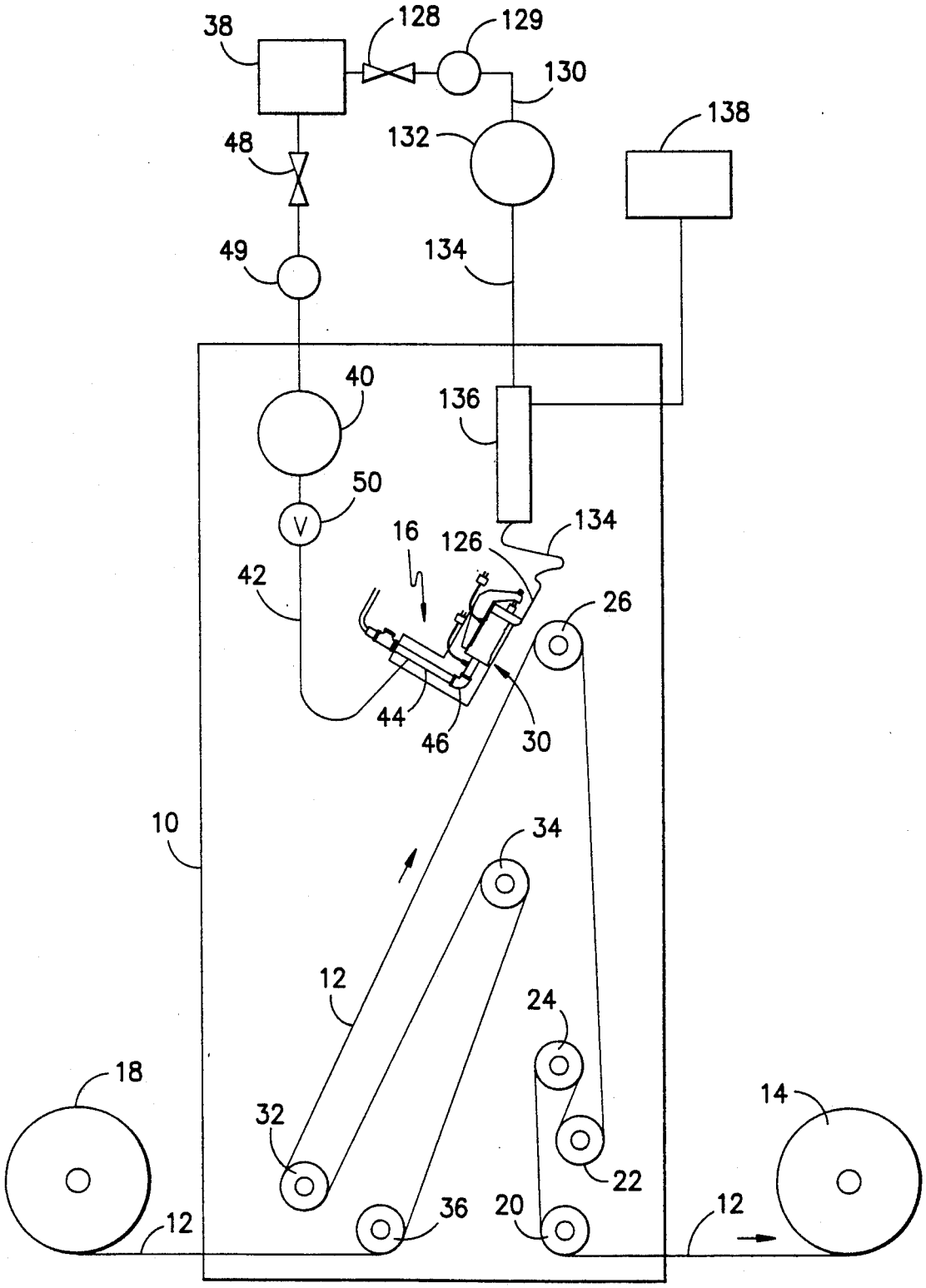
FIG. 1 is a schematic side elevation view of apparatus for heated pressurized fluid stream treatment of a moving substrate material to impart a surface pattern or change in the surface appearance thereof, and incorporating novel features of the present invention.

Referring more specifically to the drawings, FIG. 1 shows, diagrammatically, an overall side elevation view of apparatus for heated pressurized fluid stream treatment of a moving substrate material to impart a pattern of tactile or visual change thereto.

As seen, the apparatus includes a main support frame including end frame support members, one of which 10 is illustrated in FIG. 1. Suitably rotatably mounted on the end support members of the frame are a plurality of substrate guide rolls which direct an indefinite length of substrate material, such as a textile fabric 12, from a fabric supply roll 18, past a pressurized heated fluid treating unit, generally indicated at 16. After treatment, the fabric is collected in a continuous manner on a take-up roll 14. As shown, fabric 12 from supply roll 18 passes over an idler roll 36 and is fed by a pair of driven rolls 32, 34 to a main driven fabric support roll 26. The surface of the fabric passes closely adjacent to the heated fluid discharge outlet of an elongate fluid distributing manifold assembly 30 of treating unit 16. The treated fabric 12 thereafter passes over a series of driven guide rolls 22, 24 and an idler roll 20 to take up roll 14 for collection.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of heated fluid distributing manifold assembly 30 and supply heated pressurized air thereto through short, individual air supply lines, indicated at 46, which communicate with assembly 30 uniformly along its full length. Air supplied to the heated fluid distributing manifold assembly 30 is controlled by a master control valve 48, pressure regulator valve 49, and individual precision control valves, such as needle valves 50, located in each heater air supply line 42. The heaters 44 are controlled i suitable manner, as by temperature sensing means located in the outlet lines 46 of each heater, with regulation of air flow and electrical power to each of the heaters to maintain the heated fluid at a uniform temperature and pressure as it passes into the manifold assembly along its full length.

Typically, for patterning textile fabrics, such as pile fabrics containing thermoplastic pile yarns, the heaters are employed to heat air exiting the heaters and entering the manifold assembly to a uniform temperature of about 700° F.–750° F. However, the range of temperature for fabric treated with this apparatus may be between about 500° F. to about 1200° F. or more. The preferred operating temperature for any given substrate depends upon: the components of the substrate, the construction of the substrate, the desired effect, the speed of transport of the substrate, the pressure of the heated fluid, the tension of the substrate, the proximity of the substrate to the treating manifold, and others.

The heated fluid distributing manifold assembly 30 is disposed across the full width of the path of movement of the fabric and closely adjacent the surface thereof to be treated. Although the length of the manifold assembly may vary, typically in the treatment of textile fabric materials, the length of the manifold assembly may be 76 inches or more to accommodate fabrics of up to about 72 inches in width.

Figure 2:
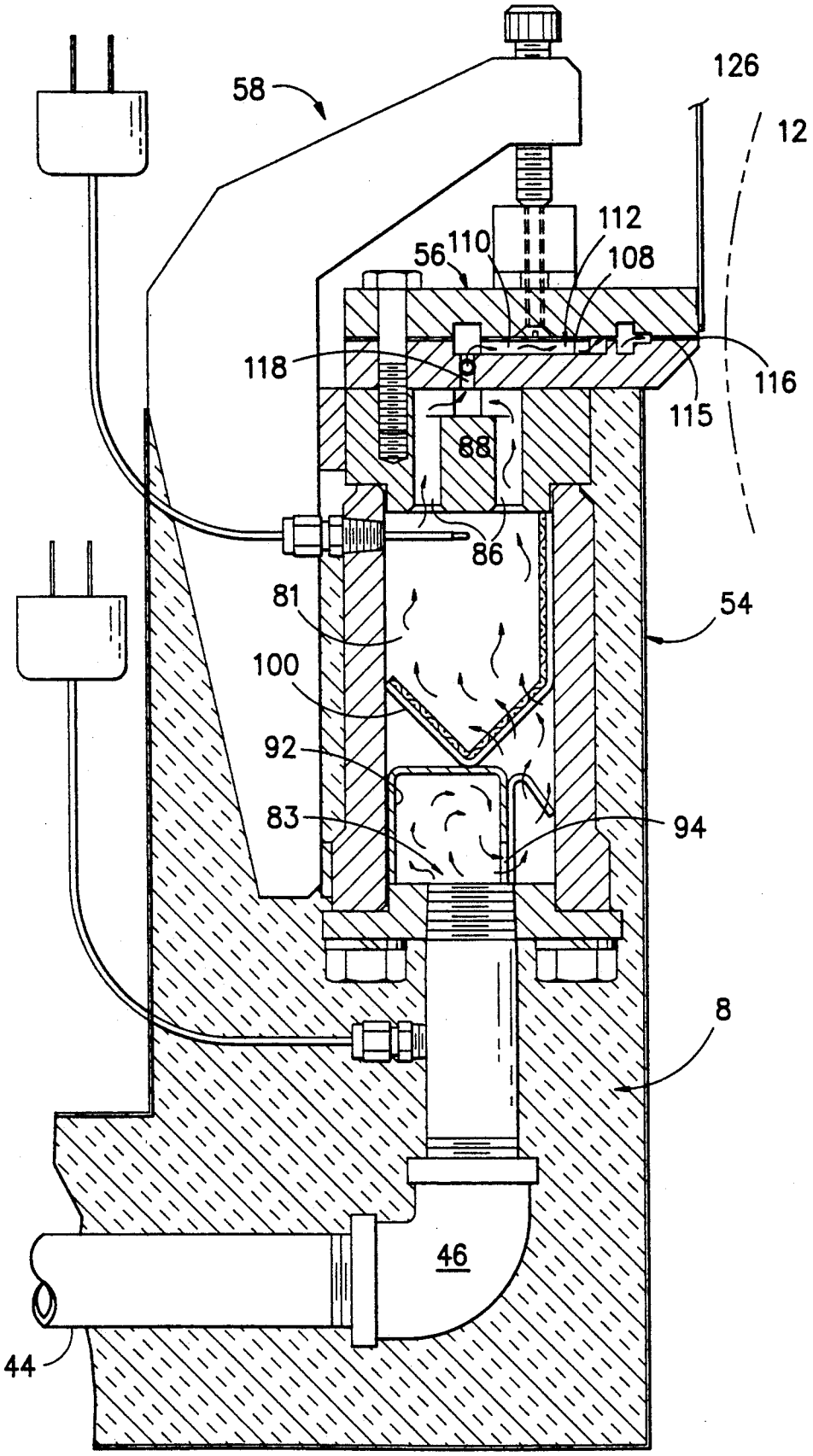
FIG. 2 is an enlarged partial sectional elevation view of the fluid distributing manifold assembly of the apparatus of FIG. 1.

Details of the heated fluid distributing manifold assembly 30 may be best described by reference to FIGS. 2–3 of the drawings. As seen in FIG. 2, which is a partial sectional elevation view through the assembly, manifold assembly 30 comprises a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the fabric 12 adjacent its path of movement.

As best seen in FIG. 2, first elongate manifold housing 54 is of generally rectangular cross-sectional shape, and includes a first elongate fluid receiving compartment 81, the ends of which are sealed by end wall plates suitably bolted thereto. Communicating with bottom wall plate through fluid inlet openings, one of which, 83, is shown in FIG. 2, and spaced approximately uniformly therealong are the air supply lines 46 from each of the electrical heaters 44.

The manifold housings 54, 56 are constructed and arranged so that the flow path of fluid through the first housing 54 is generally at a right angle to the discharge axes of the fluid stream outlets of the second manifold housing 56.

Figure 3:
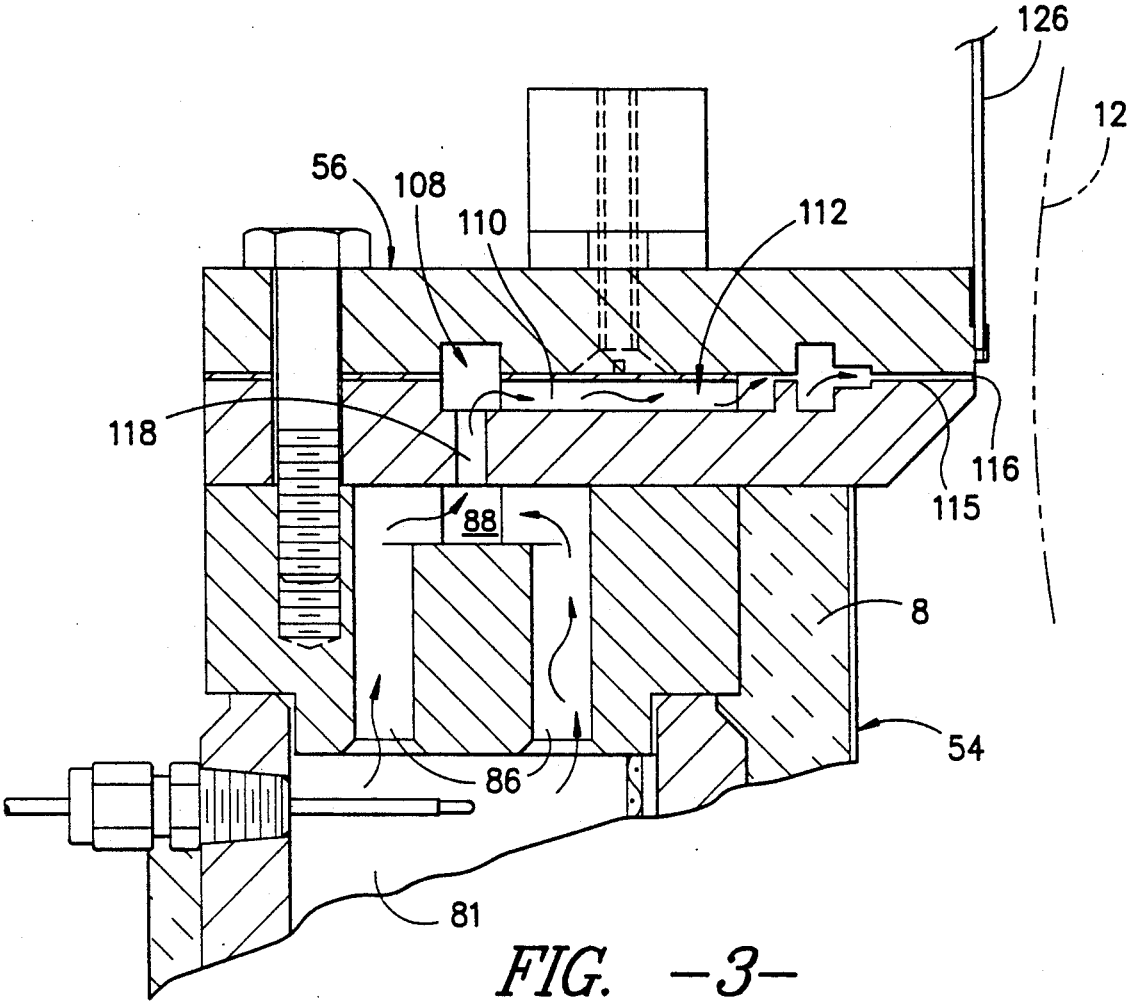
FIG. 3 is an enlarged broken away sectional view of the fluid stream distributing manifold housing of the manifold assembly as illustrated in FIG. 2.

As best seen in FIGS. 2 and 3, manifold housing 54 is provided with a plurality of fluid flow passageways 86 which are disposed in uniformly spaced relation along the plate in two rows to connect the first fluid receiving compartment 81 with a central elongate channel 88.

Baffle plate 92 serves to define a fluid receiving chamber in the compartment 81 having side openings or slots 94 to direct the incoming heated air from the bank of heaters in a generally reversing path of flow through compartment 81.

Figure 4:
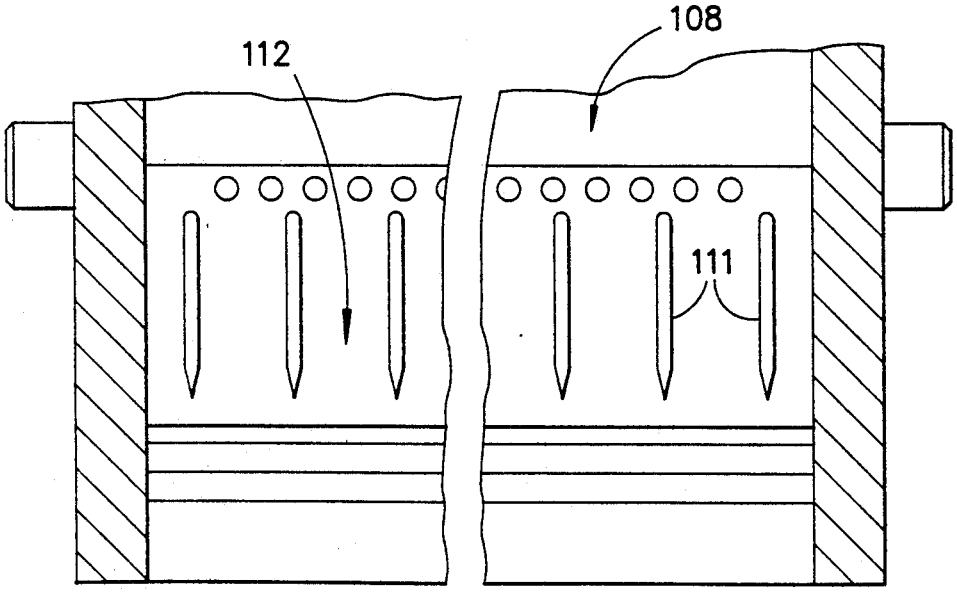
FIG. 4 is an enlarged broken away sectional view of an end portion of the fluid stream distributing manifold housing.

As seen in FIGS. 2, 3 and 4, second smaller manifold housing 56 comprises first and second opposed elongate wall members, each of which has an elongate recess or channel 108 therein. Wall members are disposed in spaced, coextensive parallel relation with their recesses 108 in facing relation to form upper and lower wall portions of a second fluid receiving compartment 110, in the second manifold housing 56. The fluid then passes through a third fluid receiving compartment 112 in the lower wall member of manifold housing 56 which is defined by small elongate islands 111 approximately uniformly spaced along the length of the member. A continuous slit directs heated pressurized air from the third fluid receiving compartment 112 in a continuous sheet across the width of the fabric at a substantially right angle onto the surface of the moving fabric substrate 12. Typically, in the treatment of textile fabrics such as pile fabrics containing thermoplastic pile yarn or fiber components with a flat woven substrate containing thermoplastic or fiber yarn, the continuous slit 115 of manifold 56 may be 0.015 to about 0.030 inch in thickness. For precise control of the heated air streams striking the fabric, the continuous slit is preferably maintained between about 0.070 to 0.080 inch from the fabric surface being treated. However, this distance from the face of the fabric can be as much as 0.100 inch and still produce good pattern definition. The deflecting air tubes are spaced 20 to the inch over the 72 inch air distributing manifold, although apparatus has been constructed as coarse as 10 to the inch and as fine as 44 to the inch.

Second manifold housing 56 is provided with a plurality of spaced fluid inlet openings 118 (FIGS. 2 and 3) which communicate with the elongate channel 88 of the first manifold housing 54 along its length to receive pressurized heated air from the first manifold housing 54 into the second fluid receiving compartment 110.

The continuous slit 115 of the second manifold housing 56 which directs a stream of air into the surface of fabric 12 is provided with tubes 126 which communicate at a right angle to the discharge axis of continuous slit 115 to introduce pressurized cool air, i.e., air having a temperature substantially below that of the heated air in third fluid receiving compartment 112, at the heated fluid discharge outlet 116 to selectively deflect the flow of heated air through the continuous slit 115 in accordance with pattern control information. Air passing through the tubes 126 may be cooled by a water jacket which is provided with cooling water from a suitable source, not shown, although such cooling is not required.

As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to deflect the flow of hot air through continuous slit 115 during movement of the fabric and thereby produce a desired pattern in the fabric. Detailed patterning information for individual patterns may be stored and accessed by means of any known data storage medium suitable for use with electronic computers, such as magnetic tape, EPROMs, etc.

The foregoing details of the construction and operation of the manifold assembly 30 of the fluid treating apparatus is the subject matter of commonly assigned U.S. Pat. No. 4,471,514 entitled "Apparatus for Imparting Visual Surface Effects to Relatively Moving Materials" and issued on Sept. 18, 1984. The disclosure thereof is included herein by reference for full description and clear understanding of the improved features of the present invention.

The improved features of the present invention may best be described by reference to FIG. 3. Each cool air fluid tube 126 is positioned at approximately a right angle to the plane defined by continuous slit 115 to deflect heated pressurized air away from surface of the moving fabric 12 (FIG. 3) as the substrate approaches continuous slit 115. This deflection is generally at about a 45 degree angle from the path defined by continuous slit 115, and serves to direct the deflected heated air towards the oncoming substrate 12. Thus, a strong blast of mixed hot and cold air strikes the surface of the substrate prior to its being subjected to the action of the heated air issuing from continuous slit 115.

This configuration of tubes 126 provides sufficient volume of air in combination with that from the continuous slit 115 to preheat substrate 12 to a temperature preferably short of permanent thermal modification.

It should be noted that, due to the insulation 8 generally surrounding manifold 54, preheating is not believed to be the result of heat radiation from the manifold, but is rather the result of the intentional exposure of substrate 12 to the heated air issuing from continuous slit 115, as that air is diverted by the relatively cool air issuing from tubes 126. The heated air used for this purpose is air that has been diverted, in accordance with patterning instructions, after issuing from continuous slit 115, i.e., this air would be diverted whether or not pre-heating was desired. Therefore, preheating of the substrate is achieved as an integral part of, and is inseparable from, the patterning process, and requires no additional or separate heated air source. By so doing, not only is a separate preheating step and its attendant complexity unnecessary, but it is believed a separate preheating step would be incapable of imparting heat of sufficient intensity and directivity to maintain the substrate at an effective preheated temperature at the instant the heated patterning air issuing from continuous slit 115 contacts the substrate as shown in FIG. 4.

This preheating may cause additional thermal modification during the patterning step. As can be seen in connection with FIG. 5, the amount of shrinkage is a function of the type of fiber involved and the temperature to which it is subjected. The temperature of the hot air is adjusted to accommodate a particular fiber so that the amount of shrinkage can be controlled regardless of the fabric.

From the foregoing description, it can be seen that the improvements of the present invention enhance the ability to carve patterns in the fabric, minimize fabric waste due to faults in the patterning process, and render the process more versatile and efficient.

What is claimed is:

1. A method for carving a pattern in a moving substrate of material to impart a visual and tactile effects thereto comprising:

(a) moving a substrate past a pattern station for forming a pattern therein;

(b) directing a continuous sheet of heated pressurized fluid against the surface of said substrate;

(c) directing pressurized cool fluid into selective portions of said heated pressurized fluid to block the path of said fluid;

(d) preheating said substrate prior to it being subjected to said step of heating with said discrete streams of pressurized fluid, wherein said preheating step includes directing cool fluid mixed with said heated pressurized fluid towards said substrate and toward a position upstream of the path of said substrate.

2. The method according to claim 1 wherein the path of said cool air is generally directed parallel to the path of said substrate.

3. The method according to claim 2 wherein said preheating step also includes deflecting hot air from said substrate imparted by said directing a continuous sheet of heated pressurized fluid against the surface of said substrate to a position upstream of the path of movement for said substrate.

4. The method according to claim 3 wherein said preheating step includes a mixture of air comprising approximately the air that impinges on the fabric and the air that is deflected by the said cool air.

5. The method according to claim 4 wherein said preheating step includes heating fabric from room temperature to a temperature below the fabric's melting point.

6. The method according to claim 5 wherein said substrate comprises a pile of a fabric made of thermally modifiable material.

7. The method according to claim 6 wherein said preheating step heats the pile sufficiently to permit the fiber subjected to heated pressurized fluid to shrink back on itself.

8. The method according to claim 7 wherein said step of directing discrete streams of heated pressurized fluid against the surface of said substrate is directed generally perpendicular to the path of said substrate and said step of preheating said substrate includes deflecting a portion of the air along the path of said directing step and directing it in a direction substantially parallel to the path of movement of said substrate to a position upstream of the movement of said substrate.

9. The method according to claim 8 wherein said preheating step is maintained on the substrate up to and adjacent the position where said carving step occurs.

10. An apparatus for treating a relatively moving substrate comprising:

(a) means for applying discrete streams of pressurized heated fluid to selected surface portions of the substrate to impart a visual and tactile effect thereto, (b) said means including an elongate fluid distributing manifold positioned across the path of relative movement of said substrate, (c) said manifold defining an elongate fluid receiving compartment and a single slit the width of the manifold disposed to direct a single sheet of pressurized fluid against the surface of the relatively moving substrate, and (d) means for directing pressurized cool fluid across selected portions of the heated fluid discharge slit to selectively deflect the passage of heated fluid thereby and wherein said fluid discharge slit is disposed adjacent to the path of movement of said substrate; and (e) means for moving said substrate along a preselected path past said manifold, and means for preheating said substrate upstream of said manifold as said substrate moves along said path, wherein said means for preheating said substrate includes heating the substrate to a temperature below melting point and said means for preheating further includes means for directing said fluid to a position upstream of the path of movement of said substrate.

11. The apparatus according to claim 10 wherein said means for deflecting fluid from said slit includes a conduit extending generally perpendicularly to said slit and having an exit for directing the air along a path generally parallel to the path of movement of said substrate.

* * * * *